US010362822B2

(12) United States Patent
Chen

(10) Patent No.: US 10,362,822 B2
(45) Date of Patent: Jul. 30, 2019

(54) MULTI-POSITIONAL, LOCKING ARTIFICIAL TREE TRUNK

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 15/851,462

(22) Filed: Dec. 21, 2017

(65) Prior Publication Data

US 2018/0206569 A1 Jul. 26, 2018

Related U.S. Application Data

(63) Continuation of application No. 14/740,926, filed on Jun. 16, 2015, now Pat. No. 9,883,706, which is a continuation of application No. 13/663,135, filed on Oct. 29, 2012, now Pat. No. 9,066,617, which is a continuation of application No. 13/112,523, filed on May 20, 2011, now Pat. No. 8,298,633.

(51) Int. Cl.
*A47G 33/06* (2006.01)
*A41G 1/00* (2006.01)

(52) U.S. Cl.
CPC ..... *A41G 1/007* (2013.01); *A47G 33/06* (2013.01); *Y10T 403/50* (2015.01); *Y10T 403/551* (2015.01); *Y10T 403/5773* (2015.01); *Y10T 403/62* (2015.01); *Y10T 403/7026* (2015.01); *Y10T 403/7035* (2015.01); *Y10T 403/7073* (2015.01)

(58) Field of Classification Search
CPC ..... A41G 1/007; A47G 33/06
See application file for complete search history.

(56) References Cited

U.S. PATENT DOCUMENTS 860,406 A * 7/1907 McGahan ..... A47G 33/06 248/908
1,495,695 A * 5/1924 Karr ..... A47G 33/06 428/20
3,249,377 A * 5/1966 Weasler ..... F16D 1/10 285/330

(Continued)

OTHER PUBLICATIONS

Decision Denying Institution of Inter Partes Review, Case IPR2016-01783, U.S. Pat. No. 9,066,617, Paper No. 15, Filed Apr. 13, 2017 (25 pages).

*Primary Examiner* — Adam Krupicka
(74) *Attorney, Agent, or Firm* — Christensen, Fonder, Dardi & Herbert PLLC

(57) ABSTRACT

A locking artificial tree trunk including a first generally cylindrical, hollow trunk portion including an upper end, the upper end defining a notch, and a second generally cylindrical trunk portion including a body portion, a lower end having an insertable portion, and an upper end. The locking artificial tree trunk also includes a coupling mechanism having a body portion and an upper portion having a tab, and defining a channel for receiving the insertable portion of the lower end of the second trunk portion. The body portion is inserted substantially into the upper end of the first trunk portion with the tab of the upper portion aligned with the notch, thereby preventing rotation of the coupling mechanism within the upper end of the first trunk portion.

14 Claims, 11 Drawing Sheets

(56) References Cited

U.S. PATENT DOCUMENTS

| | | | | | |
|---|---|---|---|---|---|
| 4,437,782 | A * | 3/1984 | Geisthoff | F16C 3/03 | 384/49 |
| 5,390,463 | A * | 2/1995 | Sollner | E04C 3/08 | 52/650.2 |
| 8,053,042 | B1 * | 11/2011 | Loomis | A47G 33/06 | 362/123 |
| 8,916,242 | B2 * | 12/2014 | Fu | A41G 1/007 | 428/20 |
| 2010/0072747 | A1 * | 3/2010 | Krize | A47G 33/06 | 285/330 |
| 2015/0072088 | A1 * | 3/2015 | Fu | A41G 1/007 | 428/20 |

* cited by examiner

MULTI-POSITIONAL, LOCKING ARTIFICIAL TREE TRUNK

RELATED APPLICATIONS

The present application is a continuation of U.S. patent application Ser. No. 14/740,926, filed Jun. 16, 2015, which is a continuation of U.S. patent application Ser. No. 13/663,135, filed Oct. 29, 2012, now U.S. Pat. No. 9,066,617, issued Jun. 30, 2015, which is a continuation of U.S. patent application Ser. No. 13/112,523, filed May 20, 2011, now U.S. Pat. No. 8,298,633, issued Oct. 30, 2012, all of which are incorporated herein in their entireties by reference.

FIELD OF THE INVENTION

The present invention is generally directed to artificial trees. More specifically, the present invention is directed to artificial trees having separable, modular tree portions mechanically connectable and lockable between trunk portions.

BACKGROUND OF THE INVENTION

For the sake of convenience and safety, consumers often substitute artificial trees constructed of metal and plastic for natural evergreen trees when decorating homes, offices, and other spaces, especially during the holidays. Such artificial trees generally include multiple tree sections joined at the trunk and held erect by a floor-based tree stand. Traditionally, consumers wrap strings of lights about the artificial tree to enhance the decorative quality of the tree display.

Manufacturers have also created "pre-lit" artificial trees to ease the burden on consumers of decorating the tree with strings of lights. Typical pre-lit trees include an artificial tree with multiple standard light strings distributed about the exterior of the tree. Wires of the light string are clipped to branch structures, while plug ends dangle throughout the branches. Generally, multi-purpose decorative light strings are used in pre-lit trees, often limited to 50 or 100 bulb assemblies, with a bladed power plug for insertion into the back outlet of another light string, or insertion into an alternating current (AC) power source.

Often, in both non-pre-lit and pre-lit trees, the connection of light strings spans more than one trunk section. If a particular trunk section is allowed to spin, the wiring of the light strings can become twisted. When twisted, light strings are at risk of plug and end connector damage and are even at risk of breaks. Safety can therefore be compromised if a trunk section is allowed to spin. Further, if a particular trunk section is allowed to spin, the tree can be difficult to decorate, as it can be difficult to arrange light strings or ornaments on a moving section of tree. Additionally, trees are often placed in the corners of rooms or up against walls. Once decorated, it is desirable for the sections of the tree to remain fixed, as the wall-facing or corner-facing sides are often left undecorated. It is therefore beneficial for artificial tree trunk sections to remain fixed in place.

Similarly, a sloppy fit between trunk sections can create wobble or unwanted tilt between sections. This can leave the tree unstable and at risk of toppling if bumped or touched. Also, a non-vertical section is undesirable from an aesthetic perspective, as a slanted tree looks visually less impressive than a perfectly vertical tree. Therefore, it is desirable to have an extremely tight fit between tree trunk sections which ensures a completely vertical tree.

Additionally, as the popularity of both pre-lit and non-pre-lit artificial trees has grown, so to have the bulk and complexity of artificial trees. Not only has the number and density of branches of a typical artificial tree increased, but, for pre-lit trees, the increase in number and density of branches likewise increases the number of lights and light strings. As a result, the weight and bulk of artificial trees has increased, thus making it difficult to lift and align individual trunk sections when assembling the tree.

Further adding to the difficulty of lifting and aligning individual trunk sections is the advent of the locking trunk section. Manufacturers have created a number of artificial trees that have locking trunk sections. These trunks have either a protrusion or void, respectively, and are insertable in only one rotational alignment into the corresponding void or protrusion, respectively, of the receiving trunk portion. Such a design provides a friction fit such that the two trunk portions cannot spin relative to one another. However, as mentioned above, because of the weight and bulk of the artificial trees, it is often difficult to perfectly align the individual trunk sections. Consumers must first locate the alignment mark on the receiving portion, then locate the corresponding alignment mark on the insertable portion, and finally adjoin the two perfectly in the identified alignment. Thus, it is desirable for trunk sections to fit universally in any rotational orientation with the receiving portion of the receiving trunk to provide a secure, tight fit between trunk sections.

Some known inventions have attempted to make artificial trees more convenient to put together. For example, U.S. Pat. No. 1,656,148 to Harris filed Apr. 5, 1926 and entitled "Artificial Christmas Tree" teaches a simple artificial tree with one embodiment having multiple tree sections that join together. The tree includes single bulbs at each end of a branch, with bulb wiring extending from inside a trunk through hollow branches. A bayonet fitting is used to adjoin the sections, a top section having a projecting pin, and a bottom section having an L-shaped bayonet slot. The two sections are coupled by aligning the projection pin with the bayonet slot and rotating to interlock the sections, thereby bringing a pair of spring contacts into alignment with a pair of terminals to make an electrical connection.

Another known artificial tree as described in U.S. Pat. No. 3,970,834 to Smith, filed Dec. 16, 1974 and entitled "Artificial Tree", describes a pre-lit tree made in sections which may be folded for easy storage. The individual tree sections include a threaded male end and a threaded female socket end. The male end of a tree section is screwed into the female end of another section. Wiring for the lights passes from the trunk through holes in branches and connects with individual lights at an interior of the branch. When the tree is screwed together, an electrical connection is made.

In another example of an artificial tree, as described in U.S. Pat. No. 6,592,094 to Kao, filed Jan. 28, 2002, a tree utilizing an internal sleeve sized to receive a tree trunk is described. The sleeve is coupled to a base section and positioned to receive the tree trunk. The sleeve is provided with longitudinally aligned friction strips that are spaced apart and tapered in height to increase the amount of friction presented to an inserted trunk. When the trunk cylinder is inserted into the sleeve, the friction strips of the sleeve press against the wall of the trunk to secure the tree.

However, such known trees still require significant manipulation and handling of the tree sections to securely align and couple the sections together. Further, such known trees fail to disclose adequate mechanical coupling and connection devices and methods that allow for a universal, snug fit that meet the needs of consumers utilizing artificial trees.

SUMMARY OF THE INVENTION

The present invention substantially meets the aforementioned needs of the industry. According to an embodiment of the present invention, a coupling mechanism like a securing sleeve or securing plug is provided to assist in joining two sections of artificial tree trunk. The sleeve or plug is receivable in a lower trunk portion and subsequently provides an aperture for receiving an upper trunk portion. The sleeve is made, for example, of plastic or rubberized material, thus making it more malleable than the metal or other nonmalleable trunk material. As such, the sleeve is able to form to the shape of both trunk portions and within any gaps present due to imperfections in the machining process to provide a more secure fit than coupling the trunk portions directly. As such, the sleeve provides a locking mechanism for the connected trunk portions. Thus, trunk portions are not allowed to spin relative to one another and remain fixed in place. There is no risk of light string damage due to twisting of the trunk sections. Additionally, the tree is easier to decorate, as the sections remain in one secured configuration. Further, one decorated, the tree is fixed in place. Also, such a fit provides for a perfectly upright tree. No tilt or wobble between trunk portions is allowed, thus making for a more visually appealing and safer tree.

The present invention also provides a universal fit between trunk sections. Consumers do not need to locate any alignment marks between insertable trunk portions and receivable trunk portions in order to lock the two portions. In one embodiment of the present invention, a "blossom" shape allows for as many as six different rotational configurations for insertion and locking of the insertable trunk portion to the receivable trunk portion. In another embodiment of the present invention, a hexagonal shape allows for a similar six different rotational configurations. In such embodiments, the consumer can assemble two trunk portions by first resting the insertable upper portion on top of the receivable lower portion (with sleeve) and making minor rotations until the insertable upper portion slides into the receivable lower portion. No visual alignment is necessary; insertion and locking can be done only on feel, which can be important when bulky and heavy branches weigh down each trunk section. In other embodiments, other shapes are also considered.

The present invention is directed to an artificial tree trunk that includes a first trunk portion that may be mechanically coupled to a second trunk portion via an intermediate securing sleeve. The first trunk portion is substantially hollow and generally includes a plurality of branch rings attached to the outside wall of the trunk and at least one notch located on the end distal the end secured to a base or stand. The notch and substantially hollow trunk are able to receive a securing sleeve. The securing sleeve includes at least one flange of the same shape as the notch of the first trunk portion such that the sleeve is insertable and securable to the first trunk portion. The length of the sleeve is shaped to contour the shape of the second trunk portion such that the first trunk portion and second trunk portion make a snug fit and cannot rotate relative to each other. The second trunk portion is substantially hollow and generally includes a plurality of branch rings attached to the outside wall of the trunk. The end of the second trunk portion insertable into the securing sleeve and first trunk portion is shaped such that, once inserted, the first trunk portion and second trunk portion make a secure fit and cannot rotate relative to each other. Each branch ring on both the first and second trunk portions generally contains a plurality of veins for receiving individual tree branches. Each vein contains an aperture for inserting a locking pin to thereby secure each branch to each vein.

Optionally, the present invention can include a securing plug operably couplable to the second trunk portion and a third trunk portion insertable into the securing plug. In such an embodiment, the second trunk portion has at least one notch located on the end distal the end secured to the first trunk portion. The notch and substantially hollow trunk are able to receive a securing plug. The securing plug includes at least one flange of the same shape as the notch of the second trunk portion such that the plug is insertable and securable to the second trunk portion. The plug contains an aperture for receiving the third trunk portion. The third trunk portion generally has branches operably coupled to the third trunk portion. In another embodiment, the third trunk portion has a branch ring, square, or any other useful shape that mirrors the shape of the third trunk portion, with veins and apertures for securing branches, just as described in the first and second trunk portions.

The present invention is not limited to the above-described embodiments. For example, while the above description recites first, second, and optionally, third trunk portions, in fact, the present invention is designed such that it is scalable to both taller and shorter implementations. In one example, in a room with 20-foot ceilings, a tree having more than three trunk portions may be desired. Having more trunk portions not only allows the tree to be built taller, but can aid in assembly and disassembly. In such an embodiment, a securing sleeve is provided not only at the junction of the first trunk portion and the second trunk portion, but also for the second trunk portion and a third trunk portion, the third trunk portion and a fourth trunk portion, and so on. The fit provided by the securing sleeves and securing plugs ensures that the entire tree remains stable and each trunk portion cannot rotate relative to any other trunk portion. In another example, a shorter tree having only two trunk portions is considered, whereby a single securing sleeve at the junction between first and second trunk portions is needed. Such trees may be useful for rooms with shorter ceilings, or for placement on tables or stands.

In another embodiment, the present invention comprises a locking artificial tree trunk. The tree trunk includes a first generally cylindrical, hollow trunk portion including an upper end, the upper end defining a notch; a second generally cylindrical trunk portion including a body portion, a lower end having an insertable portion, and an upper end; and a coupling mechanism including a body portion and an upper portion having a tab, and defining a channel for receiving the insertable portion of the lower end of the second trunk portion. The body portion is inserted substantially into the upper end of the first trunk portion with the tab of the upper portion aligned with the notch, thereby preventing rotation of the coupling mechanism within the upper end of the first trunk portion.

In another embodiment, the present invention includes an artificial tree. The tree includes a locking artificial trunk, the trunk including: a first generally cylindrical, hollow trunk portion including an upper end, the upper end defining a notch; a second generally cylindrical trunk portion including a body portion, a lower end having an insertable portion, and an upper end; and a coupling mechanism including a body portion and an upper portion having a tab, and defining a channel for receiving the insertable portion of the lower end of the second trunk portion. The sleeve body portion is inserted substantially into the upper end of the first trunk portion with the tab of the upper portion aligned with the notch, thereby preventing rotation of the coupling mechanism within the upper end of the first trunk portion. The tree also includes a plurality of branch-support rings affixed to the first and second trunk portions, a plurality of branches connected to the plurality of branch-support trunk rings, and a base defining a receiver having an inside diameter larger than an outside diameter of the lower portion of the first trunk portion such that the first trunk portion is insertable into the receiver of the base.

In yet another embodiment, the present invention comprises a multi-positional interlocking artificial tree trunk. The tree trunk includes a first generally cylindrical, hollow trunk portion including an upper end, a second generally cylindrical trunk portion including a lower end having an insertable portion, and an upper end. The trunk also includes a coupling mechanism inserted substantially into the upper end of the first trunk portion, the coupling mechanism including a body portion and an upper portion, and defining a channel for receiving the insertable portion of the lower end of the second trunk portion. The insertable portion forms an insertable, non-circular cross-section and the channel defines a non-circular channel cross-section that is complementary to, and circumferentially larger than, the insertable cross-section such that the insertable portion is insertable into the channel to secure the first trunk portion to the coupling mechanism in one of a plurality of relative rotational positions, thereby preventing rotation of the second trunk portion relative to the coupling mechanism.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be understood in consideration of the following detailed description of various embodiments of the invention in connection with the accompanying drawings, in which.

Figure 1:
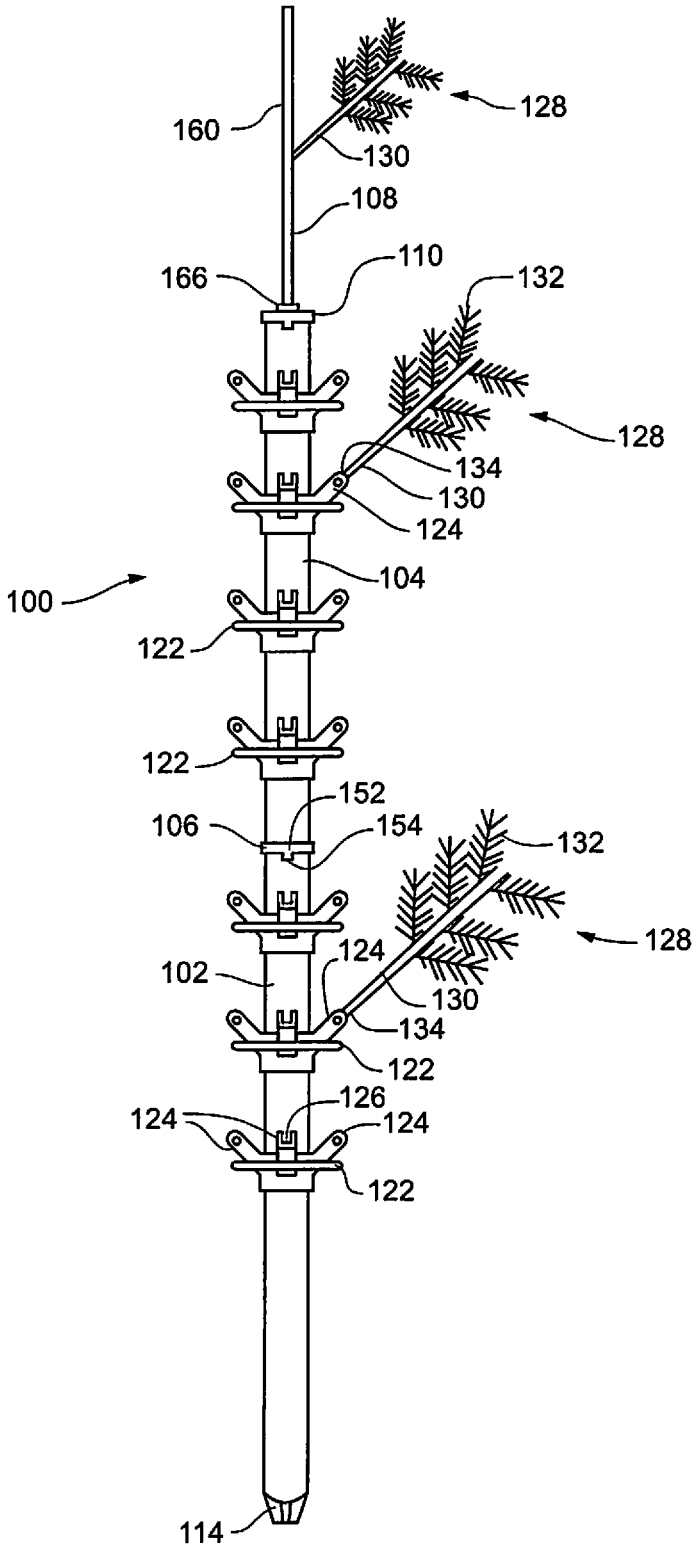
FIG. 1 is a front view of a modular, artificial tree trunk assembly, according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Referring to FIG. 1, an embodiment of an artificial tree trunk 100 of the present invention is depicted. Artificial tree trunk 100 includes first trunk portion 102, second trunk portion 104, and coupling mechanism 106. In some embodiments, artificial tree trunk 100 may include more trunk portions, such as third trunk portion 108, and may be secured by a second coupling mechanism 110, or may include fewer trunk portions. When tree trunk 100 is assembled, as depicted, trunk portions 102, 104, and 108 are aligned along a common vertical axis and held in a general vertical orientation. To maintain the general vertical orientation, first trunk portion 102 is insertable into a base or stand portion (not depicted) that supports the entire assembly. Such a base includes a receiver, such as a channel or other opening, as understood by those skilled-in-the-art, for receiving a bottom portion of trunk portion 102, the receiver having an inside diameter equal to or slightly larger than, an outside diameter of the bottom portion of trunk portion 102.

Figure 2:
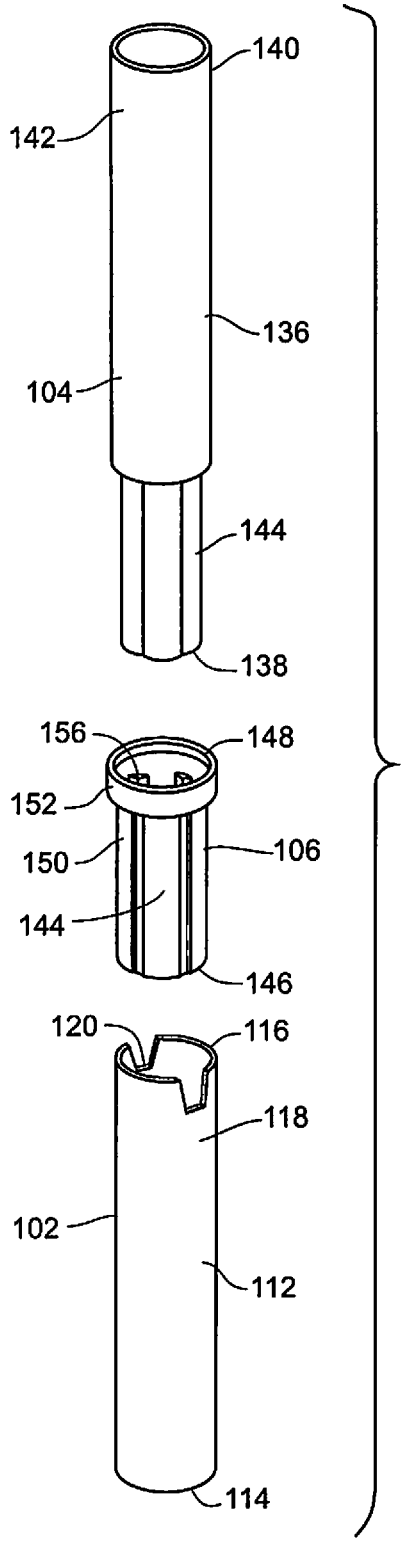
FIG. 2 is an exploded view of a first trunk portion, a securing sleeve, and a second trunk portion according to an embodiment of the present invention.
Figure 3:
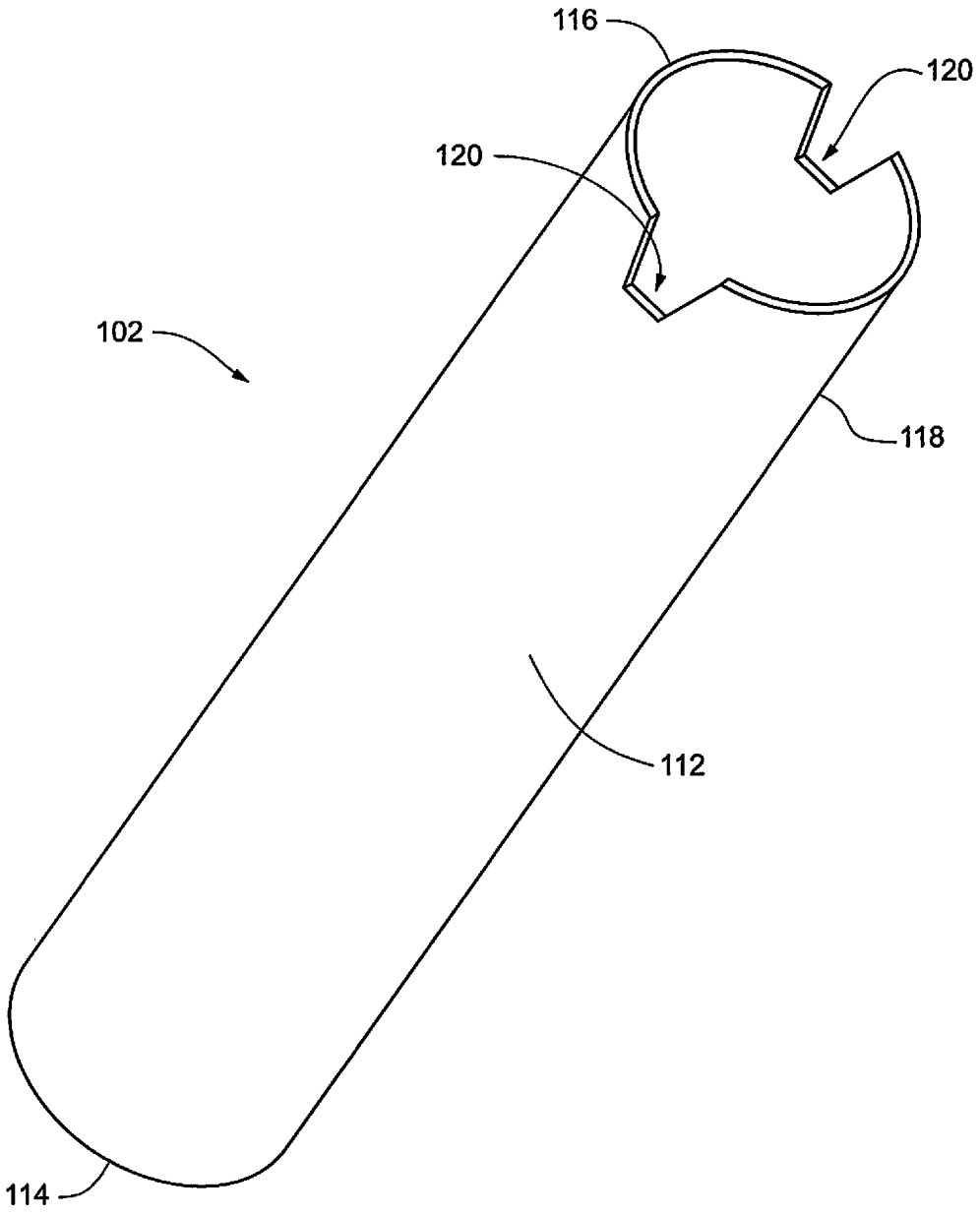
FIG. 3 is a perspective view of the first trunk portion depicted in FIG. 2.
Figure 4:
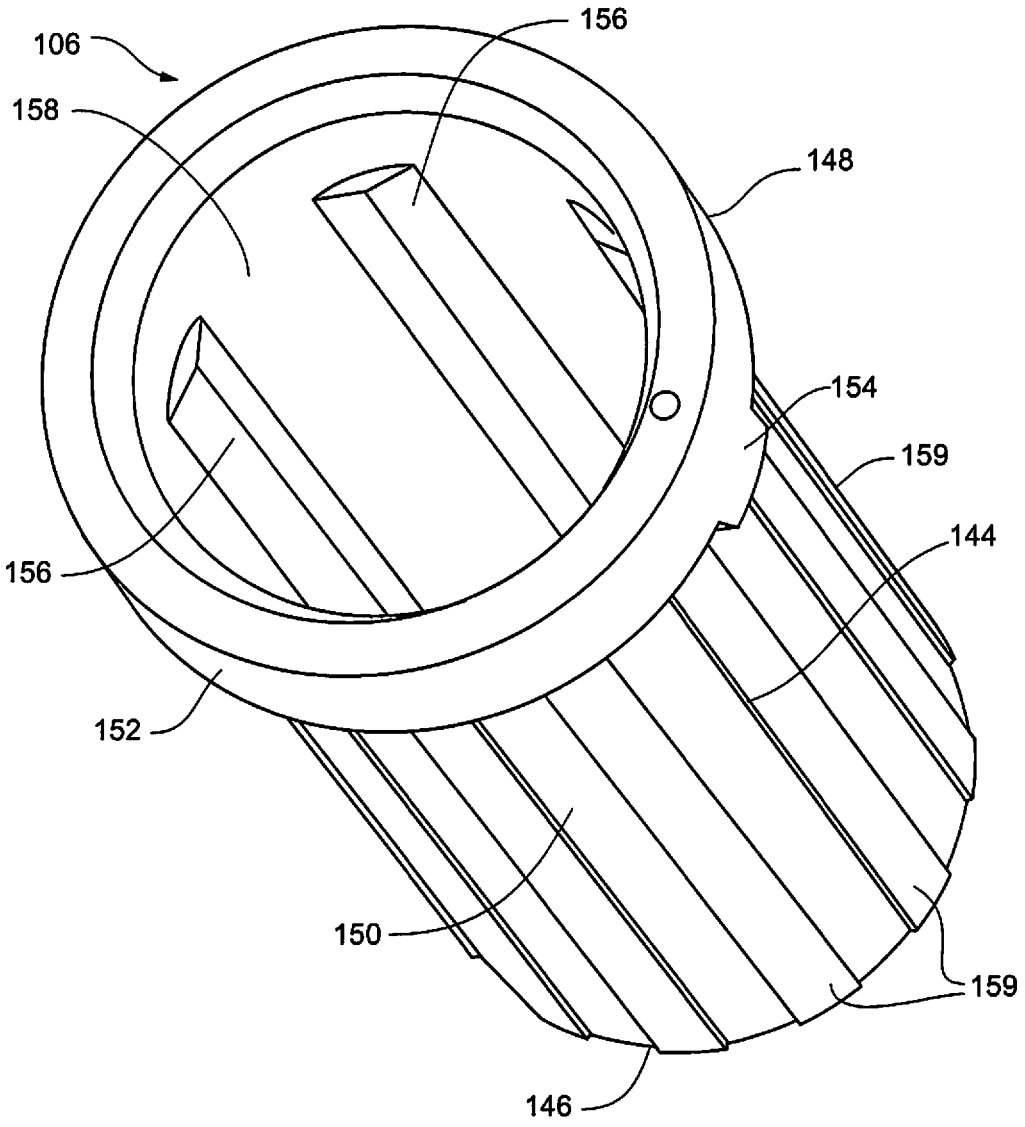
FIG. 4 is a perspective view of the securing sleeve depicted in FIG. 2.

Referring also to FIGS. 2-3, first trunk portion 102 as depicted comprises a generally cylindrical, hollow structure including trunk portion body 112 having a lower end 114, an upper end 116, outside wall 118, and one or more branch-support rings 122. One or more notches 120 are defined in upper end 116 of outside wall 118.

Lower end 114 of first trunk portion 102 may be tapered as depicted in FIG. 1 or not tapered as depicted in FIG. 2 for ease of coupling to an appropriate base or stand portion.

One or more notches 120 may be substantially trapezoidal as depicted in FIGS. 2-3, or substantially rectangular, or any other shape useful in receiving a tab and keeping the tab fixed in place by having opposite containing edges.

Branch-support rings 122 include multiple branch receivers 124 extending outwardly and away from first trunk portion 102. In some embodiments, branch receivers 124 define a channel 126 for receiving a primary branch extension 130 of a branch 128.

Each branch 128 generally includes primary branch extension 130 and may also include multiple secondary branch extensions 132 extending away from branch extension 130. Branch 128 is connected to trunk portion 102 at a branch receiver 124 at trunk-end 134.

Primary branch extension 130 of branches 128 may be bent or otherwise formed to define a loop or circular opening such that primary branch extension 130 of branch 128 may be secured to branch receiver 124 by way of a pin (not depicted) extending through branch receiver 124 and the loop formed at trunk-end 134 of branch 128. In this way, a branch 128 may be allowed to pivot about the pin and branch receiver 124, allowing first trunk portion 102 to collapse to a smaller envelope size for convenient storage.

Figure 5:
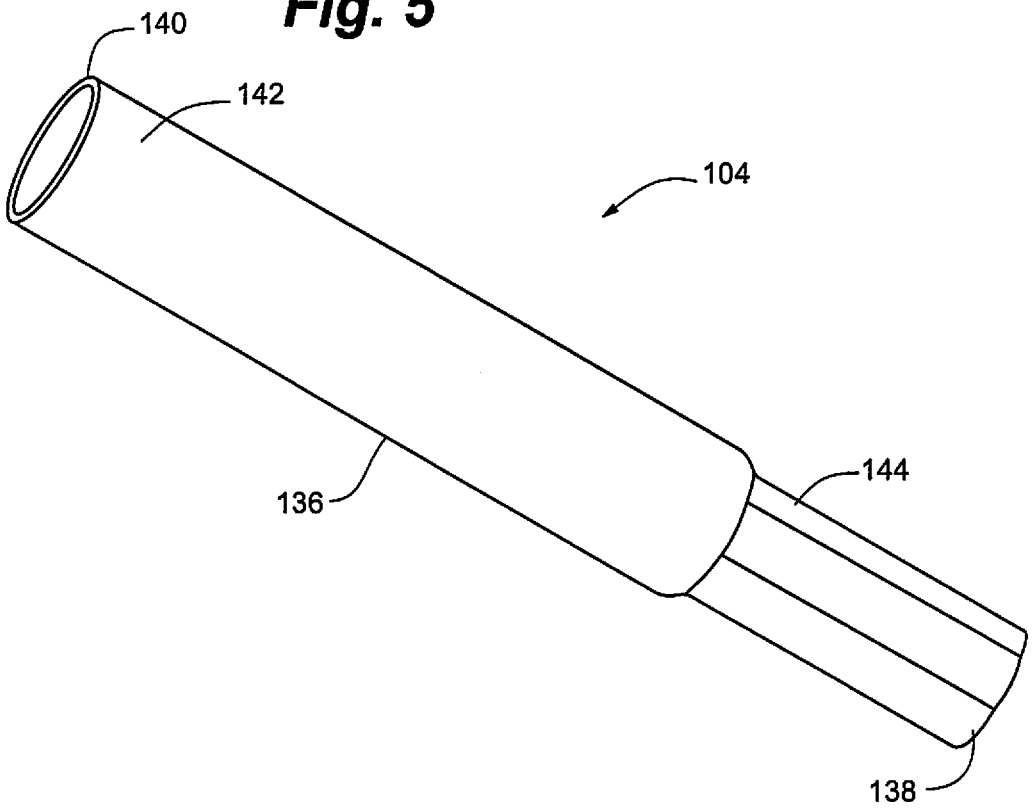
FIGS. 5-6 are perspective views of the second trunk portion depicted in FIG. 2.
Figure 6:
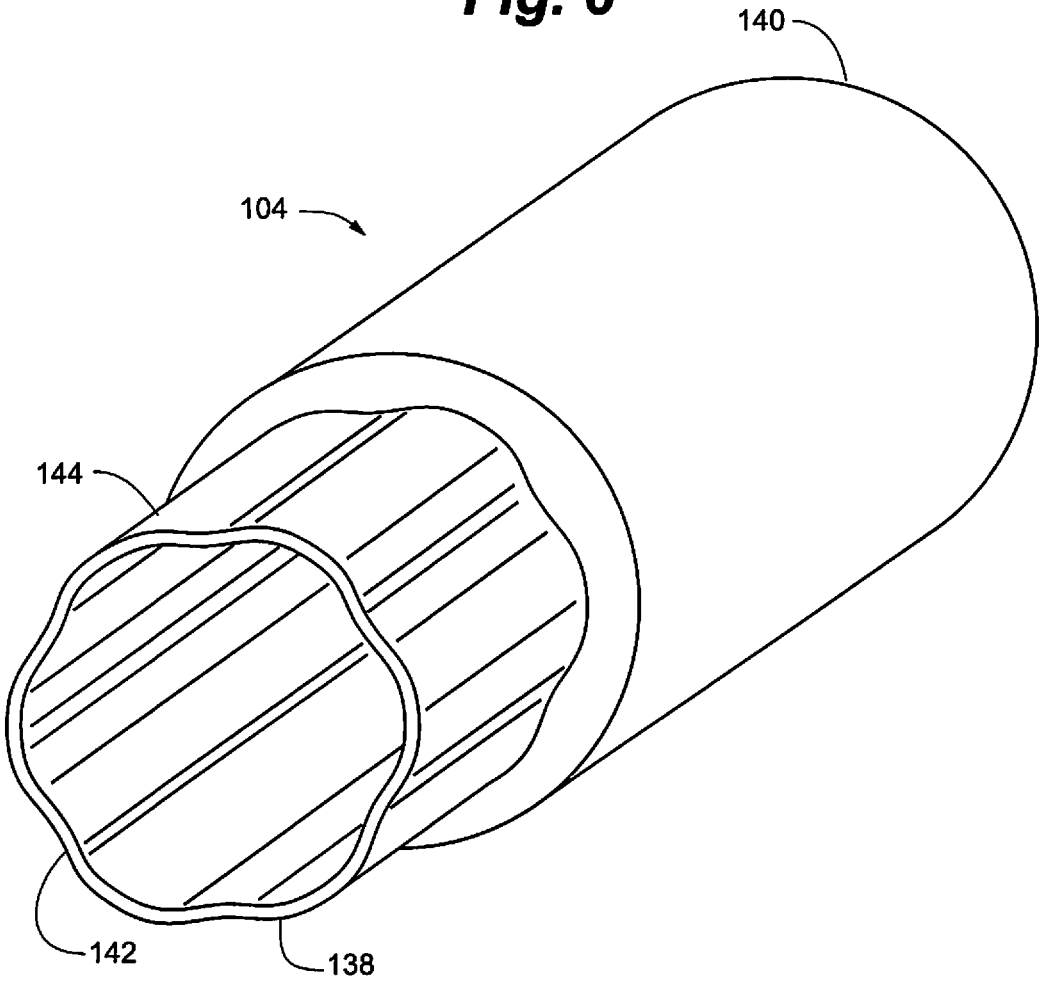

Referring also to FIG. 2 and FIGS. 5-6, second trunk portion 104 as depicted also comprises a generally cylindrical, hollow structure including trunk portion body 136 having a lower end 138, an upper end 140, outside wall 142, and in some embodiments, one or more branch-support rings 122. A length of insertable portion 144 of trunk portion body 136 may vary depending on overall tree height. A taller tree will generally require a longer insertable portion 144. In some embodiments, the length of insertable portion 144 ranges from 10% to 35% of the length of its corresponding trunk portion 104. Insertable portion 144 is defined by a relative circumference that is not perfectly circular, and is smaller than the circumference of the rest of second trunk portion 104.

In an embodiment, insertable portion 144 may be shaped such the outside wall 142 of insertable portion 144 forms a: "blossom" having a plurality of substantially semi-circular ridges all connected to form an enclosed blossom shape. In such an embodiment, the apertures formed by the connecting of the semi-circular ridges at the relative vertices, in combination with the ridges themselves, form one half of a locking mechanism. In another embodiment, referring to FIGS. 7-8, as depicted, second trunk portion 204 has an insertable portion 216 that forms a hexagonal shape having six edges and six vertices. In such an embodiment, the edges in combination with the vertices form one half of a locking mechanism.

In other embodiments, the second trunk portion can have an insertable portion comprising any number of useful shapes having edges and vertices, like a rectangle, square, parallelogram, octagon, heptagon, pentagon, etc. The more repeating edges or ridges of the shape, the easier the sections will be to align because less rotation is required to line up to the corresponding rib or aperture of the receiving other half of the locking mechanism. However, a shape having a substantial edge or ridge is desirable in order to provide leverage against rotation of the first and second trunk portions, once seated. As the shape approaches a circle, the locking mechanism will be less and less effective.

Similar to first trunk portion 102, primary branch extension 130 of branches 128 extending from second trunk portion 104 may be bent or otherwise formed to define a loop or circular opening such that primary branch extension 130 of branch 128 may be secured to branch receiver 124 by way of a pin (not depicted) extending through branch receiver 124 and the loop formed at trunk-end 134 of branch 128. In this way, a branch 128 may be allowed to pivot about the pin and branch receiver 124, allowing second trunk portion 102 to collapse to a smaller envelope size for convenient storage.

Coupling mechanism 106 as depicted in FIGS. 1-3 comprises a substantially sleeve-shaped hollow structure including body portion 144 having a lower end 146, an upper end 148, an outside wall 150, an inner surface 158 formed by the opposite side of outside wall 150, and radially-extending ribs 156 that run along at least a portion of the length of the inner surface 158. In an embodiment, outside wall 150 may also form multiple longitudinal rib-like projections 159 along a length of body portion 144.

Coupling mechanism 106 further comprises lip 152 that extends over a portion of body portion 144 from upper end 148. Lip 152 includes one or more tabs 154 located on the distal edge of lip 152, such that one or more tabs 154 extends beyond the edge of lip 154. The void created by the outside wall 150 and the underside of lip 152 defines a channel for receiving first trunk portion 102 at upper end 116. One or more tabs 154 mirror the shape of one or more notches 120 defined in the upper end 116 of outside wall 118 of first trunk portion 102 so that one or more notches 120 can receive the one or more tabs 154 and make a fit such that the opposite containing edges of the one or more notches 120 restrict the movement of the one or more tabs 154 and therefore the entire coupling mechanism 106.

Radially-extending ribs 156 along at least a portion of the length of the inner surface 158 of body portion 144 form channels mirroring the shape of the ridges or edges of second trunk portion 104. Likewise, the ribs 156 themselves mirror the shape of the apertures formed by the connecting of the ridges or edges. In such a configuration, insertable portion 144 of second trunk portion 104 is slideable along the inner surface 158 of coupling mechanism 106 such that coupling mechanism 106 can receive insertable portion 144 and therefore, second trunk portion 104. In another embodiment, referring to FIG. 7 and FIG. 9, coupling mechanism 206 has radially-extending ribs 230 that are substantially flat along the inner surface 232, but form channels that mirror the shape of the vertices of the edges around second trunk portion 204 in a hexagonal shape. In such a configuration, insertable portion 216 of second trunk portion 204 is slidable along the inner surface 232 of coupling mechanism 206 such that coupling mechanism 206 can receive insertable portion 216 and therefore second trunk portion 204.

Coupling mechanism 106 is designed to have an outside wall 150 circumference slightly less than the circumference of first trunk portion 102, and an inner surface 158 relative circumference greater than the relative circumference of the shape of insertable portion 144 of second trunk portion 104. Coupling mechanism 106 can be made of a plastic or rubberized material, thus enabling a tighter fit between first and second trunk portions. For example, injection-molded plastic, polyethylene, or polypropylene are considered.

In another embodiment not depicted, the interlocking pieces of second trunk portion 104 and coupling mechanism 106 may be swapped. For example, the ribs that, in previously-described embodiments, extend along a portion of the length of the coupling mechanism 106 body portion 144 may instead be machined into the insertable portion 144 of trunk portion body 136 of second trunk portion 104. In such a configuration, the insertable portion 144 forms channels for insertion rather than coupling mechanism 106. Likewise, the edges, ridges, and vertices of insertable portion 144 in previously-described embodiments may instead be formed into the inner surface 158 of body portion 144.

Figure 11:
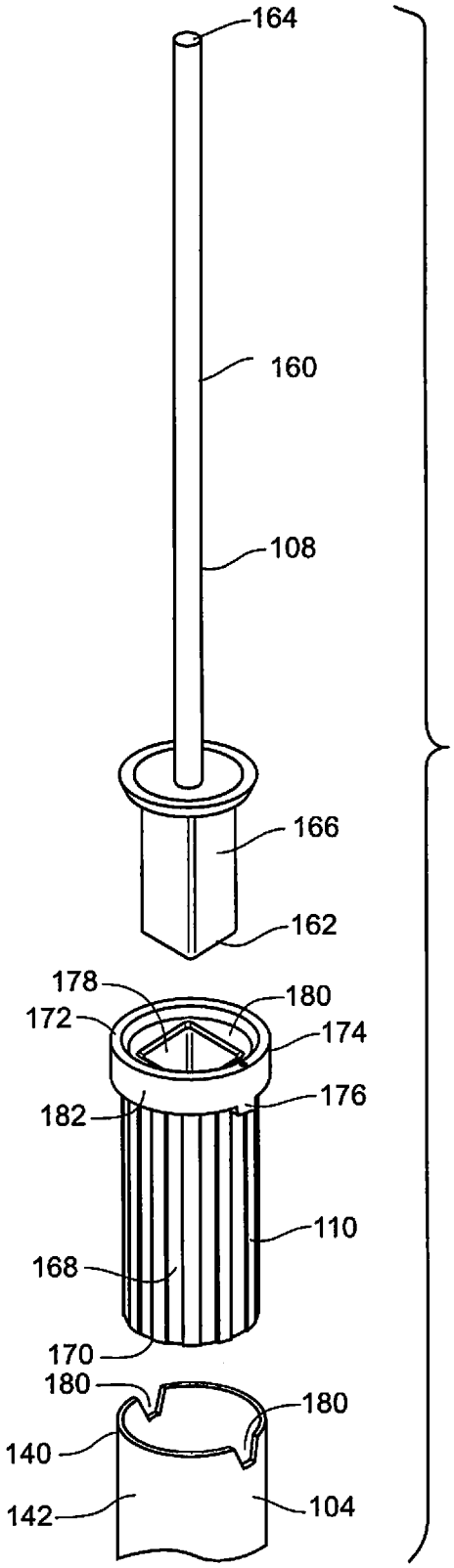
FIG. 11 is an exploded view of a trunk portion, a securing plug, and an upper trunk portion according to an embodiment of the present invention.

Optionally, and as shown in FIG. 1 and FIG. 11, artificial tree trunk 100 may include third trunk portion 108 and coupling mechanism 110. In such an embodiment, second trunk portion 104 further comprises one or more notches 180 defined in upper end 140 of outside wall 142.

Third trunk portion 108 comprises a generally cylindrical, hollow structure including trunk portion body 160 having a lower end 162, and an upper end 164. In an embodiment, third trunk portion 108 further comprises base 166 extending vertically from lower end 162 to a point along trunk portion body 160. Base 166 encloses around trunk portion body 160 to create an insertable portion that is wider than trunk portion body 160 itself. Base 166 comprises a non-cylindrical shape, for example, a square as depicted in FIG. 11. Such a shape creates a non-rotatable trunk portion when secured in a similarly-shaped aperture in coupling mechanism 110. In an alternative embodiment without base 166, trunk portion body 160 is non-cylindrical. For example, trunk portion body 160 may comprise a hexagonal shape. When secured in a similarly-shaped aperture in coupling mechanism 110, third trunk portion 108 is likewise non-rotatable.

Third trunk portion 108 may further comprise branch-support rings (not depicted) adaptable to couple to the body 160 of third trunk portion 108, where multiple branch receivers extend outwardly and away from third trunk portion 108, just as branch-support rings 122 along first trunk portion 102 and second trunk portion 104. In some embodiments, branch receivers define a vein for receiving a primary branch extension 130 of a branch 128. In an alternative embodiment, branches 128 are directly coupled to the body 160 of third trunk portion 108.

Coupling mechanism 110 comprises a substantially plug-shaped hollow structure including plug body 168 having a lower end 170, an upper end 172, an outside wall 174, and a top wall 180 formed orthogonally from the plug body 168 across the opening at upper end 172. Coupling mechanism 110 further comprises lip 182 that extends over a portion of plug body 168 from upper end 172. Lip 182 includes one or more tabs 176 located on the distal edge of lip 182, such that one or more tabs 176 extends beyond the edge of lip 182. The void created by the outside wall 174 and the underside of lip 182 defines a channel for receiving second trunk portion 104 at upper end 140. One or more tabs 176 mirror the shape of one or more notches 180 defined in the upper end 140 of outside wall 142 of second trunk portion 104 so that one or more notches 180 can receive the one or more tabs 176 and make a fit such that the opposite containing edges of the one or more notches 180 restrict the movement of the one or more tabs 176 and therefore the entire coupling mechanism 110. Aperture 178 defined in the center of top wall 180 mirrors the shape and length of trunk portion body 160, if an embodiment without a base, or base 166 if an embodiment with a base.

In the aforementioned configurations, third trunk portion 108 is connectable to second trunk portion 104 by coupling mechanism 110. In an embodiment of third trunk portion 108 without base 166, trunk portion body 160 is directly insertable into similarly-shaped aperture 178 of top wall 180. In an embodiment of third trunk portion 108 with base 166, trunk portion body is insertable by inserting base 166 into similarly-shaped aperture 178 of top wall 180.

Figure 7:
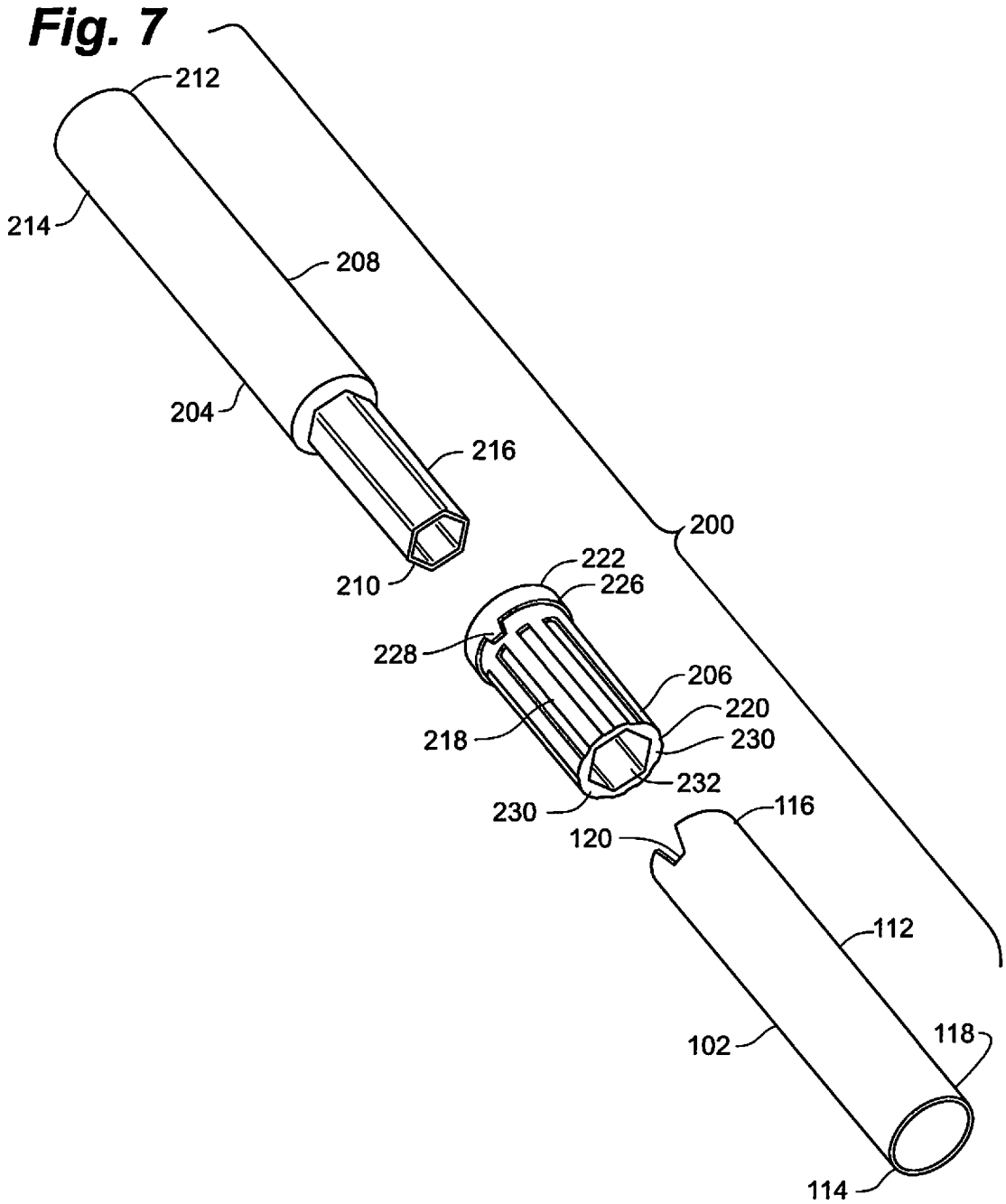
FIG. 7 is an exploded view of a first trunk portion, a securing sleeve, and a second trunk portion according to an embodiment of the present invention.
Figure 8:
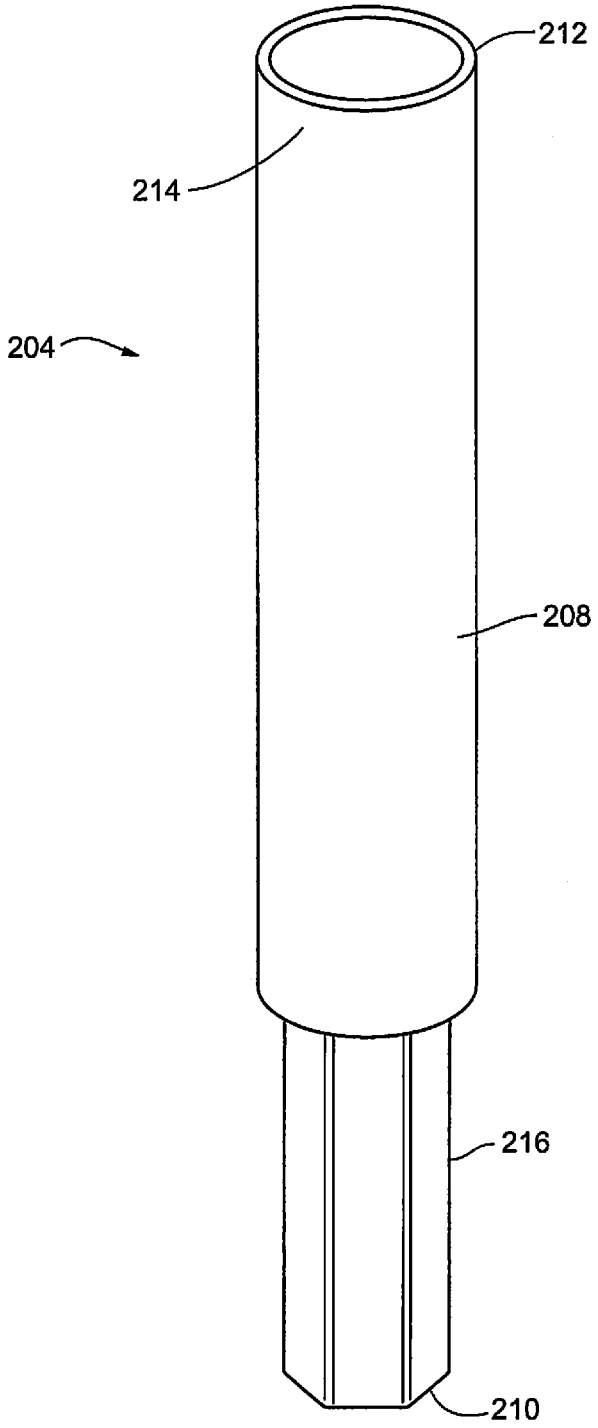
FIG. 8 is a perspective view of the second trunk portion depicted in FIG. 7.
Figure 9:
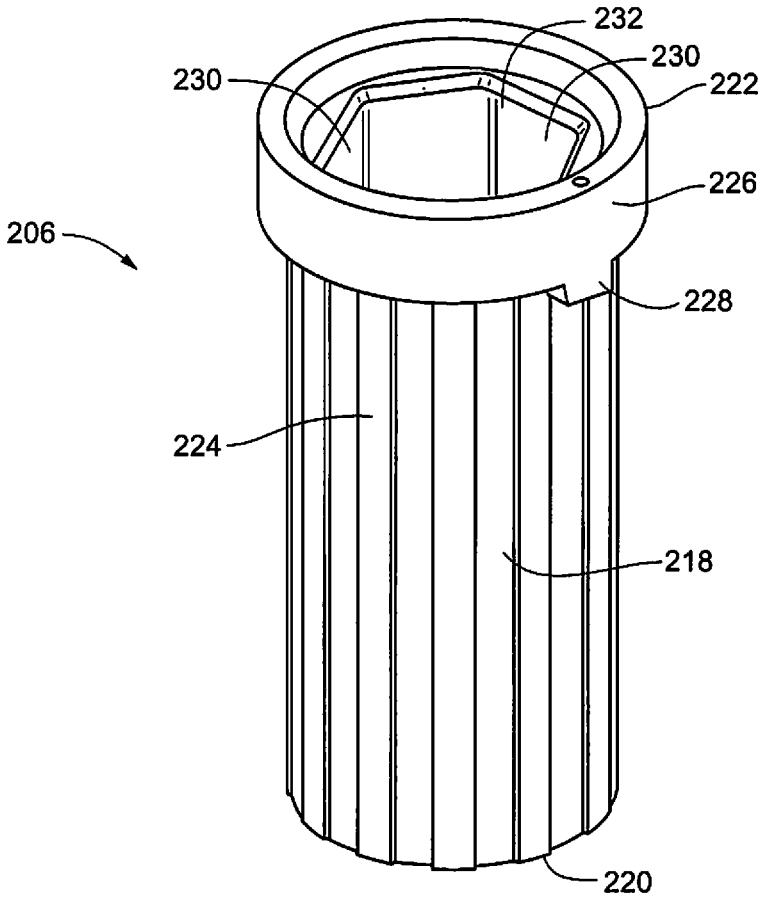
FIG. 9 is a perspective view of the securing sleeve depicted in FIG. 7.

In another embodiment of an artificial tree trunk 200, as briefly discussed above with respect to the second trunk portion and coupling mechanism, and referring to FIGS. 7-9, the shape of second trunk portion and coupling mechanism are not limited to a blossom. Artificial tree trunk 200 includes first trunk portion 102, second trunk portion 204, and coupling mechanism 206.

First trunk portion 102 as described above can be utilized in the embodiment of artificial tree trunk 200.

Similar to artificial tree trunk 100, artificial tree trunk 200 has a second trunk portion 204 that comprises a generally cylindrical, hollow structure including trunk portion body 208 having a lower end 210, an upper end 212, outside wall 214, and in some embodiments, one or more branch-support rings 122 (not depicted). A length of insertable 144 of trunk portion body 136 may vary depending on overall tree height. A taller tree will generally require a longer insertable portion 144. In some embodiments, the length of insertable portion 144 ranges from 10% to 35% of a length of its corresponding trunk portion 104. Insertable portion 216 is defined by a relative circumference that is not perfectly circular, and is smaller than the circumference of the rest of second trunk portion 204. As described above in relation to artificial tree 100 embodiment, second trunk portion 204 has an insertable portion 216 that forms a hexagonal shape having six edges and six vertices.

Coupling mechanism 206 as depicted in FIGS. 7-9 comprises a substantially sleeve-shaped hollow structure including sleeve body 218 having a lower end 220, an upper end 222, an outside wall 224, an inner surface 232 formed by the opposite side of outside wall 224, and radially-extending ribs 230 that run along at least a portion of the length of the inner surface 232. Coupling mechanism 206 further comprises lip 226 that extends over a portion of sleeve body 218 from upper end 222. Lip 226 includes one or more tabs 228 located on the distal edge of lip 226, such that one or more tabs 228 extends beyond the edge of lip 226. The void created by the outside wall 224 and the underside of lip 226 defines a channel for receiving first trunk portion 102 at upper end 116. One or more tabs 228 mirror the shape of one or more notches 120 defined in the upper end 116 of outside wall 118 of first trunk portion 102 so that one or more notches 120 can receive the one or more tabs 228 and make a fit such that the opposite containing edges of the one or more notches 120 restrict the movement of the one or more tabs 228 and therefore the entire coupling mechanism 206.

As described above in relation to artificial tree 100 embodiment, coupling mechanism 206 has radially-extending ribs 230 that are substantially flat along the inner surface 232 and thereby form channels that mirror the shape of the vertices of the edges around second trunk portion 204 in a hexagonal shape.

Artificial tree 200 may also optionally include third trunk portion 108 and coupling mechanism plug 110 as depicted in FIG. 1 and FIG. 11.

In an embodiment, in operation, to assemble artificial tree 100, first trunk portion 102 is positioned orthogonally relative to the ground, with lower end 114 affixed in a base or stand and upper end 116 pointed upward. Branches 128 are folded down along the axis of branch receiver 124 pin to create a fully extended branch in a display (non-storage) configuration. If needed, branch extensions 132 are bent or otherwise formed to fill out any gaps in the tree branches.

Coupling mechanism 106 is aligned above first trunk portion 102 at upper end 116 such that, when inserted downward into first trunk portion 102, one or more tabs 154 of coupling mechanism 106 align with one or more notches 120 of first trunk portion 102. Once so aligned, force is applied downward on coupling mechanism 106 until it fits snugly inside the aperture created by the cylinder of the body 112 at upper end 116 of first trunk portion 102 in an interference fit. When fully seated, the upper end 116 of first trunk portion 102 makes contact with the channel created by the outside wall 150 and the underside of lip 152 of coupling mechanism 106.

Second trunk portion 104 is positioned above the new combination of coupled first trunk portion 102 and coupling mechanism 106. Force is applied downward on second trunk portion 104 so that it contacts coupling mechanism 106. If the corresponding edges or ridges of second trunk portion 104 align with the channels created by radially-extending ribs 156 along at least a portion of the length of the inner surface 158 of body portion 144 of the insertable portion 144 of coupling mechanism 106, second trunk portion 104 will slide easily into the receivable inner surface 156 of coupling mechanism 106. However, if the edges or ridges of second trunk portion 104 are not aligned with the channels of coupling mechanism 106, a slight rotation of second trunk portion 104 is required.

In an embodiment utilizing a blossom shape for insertable portion 144 of second trunk portion 104 wherein six substantially semi-circular ridges extend radially along the length of insertable portion 144, no more than a maximum of 30 degrees of rotation is required one way or the other, depending on where the ridges align with the radially-extending ribs 156. Such a minimal rotation provides a significant advantage over known trunks. Most known trunks include trunk sections that spin freely about one another. Others require that the trunk sections be rotationally aligned to a single, predetermined locking position. As the size and weight of artificial trees increase, especially pre-lit trees, including hundreds, even thousands, of lights supporting a second trunk section aloft while rotating and aligning it relative to a first trunk section is cumbersome and difficult. Consequently, universal, or multi-point alignment feature, of the present trunk and coupling device provide significant advantages over the prior art.

Figure 10:
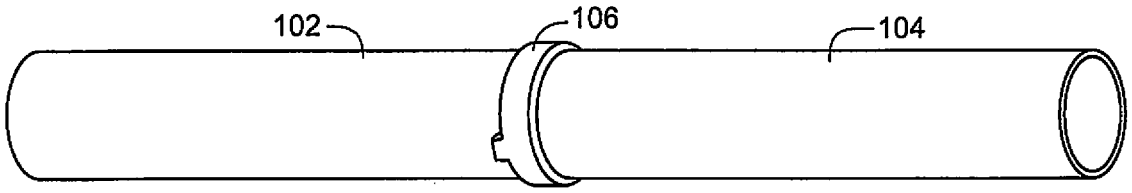
FIG. 10 is a perspective view of two trunk portions in a coupled configuration by a securing sleeve according to an embodiment of the present invention.

Once seated, second trunk portion 104 remains fixed by means of an interference fit. Without branches, the coupling of second trunk portion 104 to the coupled combination of first trunk portion 102 and coupling mechanism 106 is depicted in FIG. 10. Branches 128 are operably coupled to second trunk portion 104 as described above with respect to first trunk portion 102. Or, if already coupled to second trunk portion 104, branches 128 are folded along the axis of the branch receiver 124 pin as described above with respect to first trunk portion 102.

Optionally, to couple third trunk portion 108 to first and second trunk portions 102 and 104, coupling mechanism 110 is aligned above second trunk portion 104 at upper end 140 such that, when inserted downward into second trunk portion 104, one or more tabs 176 of coupling mechanism 110 align with one or more notches 180 of second trunk portion 104. Once so aligned, force is applied downward on coupling mechanism 110 until it fits snugly inside the aperture created by the cylinder of the body 136 at upper end 140 of second trunk portion 104 in an interference fit. When fully seated, the upper end 140 of second trunk portion 104 makes contact with the channel created by the outside wall 174 and the underside of lip 182 of coupling mechanism 110.

Third trunk portion 108 is positioned above the new combination of coupled first trunk portion 102, coupling mechanism 106, second trunk portion 104, and coupling mechanism 110. Force is applied downward on third trunk portion 108 so that it contacts coupling mechanism 110. If the corresponding edges, ridges, or base 166 of third trunk portion 108 align with the edges of aperture 178 of top wall 180 across the opening at upper end 172 of coupling mechanism 110, third trunk portion 108 will slide easily into the aperture 178 of coupling mechanism 110. However, if the edges or ridges of third trunk portion 108 are not aligned with the edges of aperture 178, a slight rotation of third trunk portion 108 is required, just as described in relation to the seating of second trunk portion 104 into coupling mechanism 106. Once seated, third trunk portion 108 remains fixed by means of an interference fit. Again branches 128 are operably coupled to third trunk portion 108 as described above with respect to first trunk portion 102 and second trunk portion 104. Or, if already coupled to third trunk portion 108, branches 128 are folded along the axis of the branch receiver 124 pin as described above with respect to first trunk portion 102 and second trunk portion 104.

To disassemble artificial tree 100, in an optional embodiment utilizing third trunk portion 108 and coupling mechanism 110, force is applied vertically to third trunk portion 108 near coupling mechanism 110 such that the interference fit between third trunk portion 108 and coupling mechanism 110 is disrupted enough to recede third trunk portion 108 from the aperture 178 of coupling mechanism 110. Optionally, branches 128 may be pivoted about the pin and branch receiver 124, allowing third trunk portion 108 to collapse to a smaller envelope size for convenient storage.

Once third trunk portion 108 is removed and coupling mechanism 110 is fully exposed on along upper end 140 of second trunk portion 104, force is applied vertically to coupling mechanism 110 such that the interference fit between coupling mechanism 110 and second trunk portion 104 is disrupted enough to recede coupling mechanism 110 from the aperture created by the cylinder of the body 136 at upper end 140 of second trunk portion 104. Optionally, coupling mechanism 110 may remain coupled to second trunk portion 104 in storage.

Force can then be applied vertically to second trunk portion 104 near coupling mechanism 106 such that the interference fit between second trunk portion 104 and coupling mechanism 106 is disrupted enough to recede second trunk portion 104 from the inner surface 158 of coupling mechanism 106. Optionally, branches 128 may be pivoted about the pin and branch receiver 124, allowing second trunk portion 104 to collapse to a smaller envelope size for convenient storage.

Once second trunk portion 104 is removed and coupling mechanism 106 is fully exposed on along upper end 116 of first trunk portion 102, force is applied vertically to coupling mechanism 106 such that the interference fit between coupling mechanism 106 and first trunk portion 102 is disrupted enough to recede coupling mechanism 106 from the aperture created by the cylinder of the body 112 at upper end 116 of first trunk portion 102. Optionally, coupling mechanism 106 may remain coupled to first trunk portion 102 in storage.

First trunk portion 102 can then be removed or disengaged from the base or stand to which it was coupled. Optionally, branches 128 may be pivoted about the pin and branch receiver 124, allowing first trunk portion 102 to collapse to a smaller envelope size for convenient storage.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

What is claimed is:

1. An artificial tree, comprising:

a first tree portion comprising a generally cylindrical, hollow first trunk portion including a first end and a second end, and a plurality of branches attached to the first trunk portion, the second end of the generally cylindrical, hollow first trunk portion defining a generally circular edge;

a second tree portion configured to be coupled to the first tree portion, the second tree portion comprising a generally cylindrical, hollow second trunk portion including a first end and a second end, and a plurality of branches attached to the second trunk portion; and a coupling mechanism located substantially within the second end of the first trunk portion, the coupling mechanism comprising a body portion inserted into the second end of the first trunk portion and having an upper end, a lower end and an inside cavity defined by a cylindrical inner surface of the body portion, and a flange portion, the flange portion adjacent to and in contact with the generally circular edge of the first trunk portion, the body portion having a plurality of ribs on the cylindrical inner surface and extending axially in a direction from the upper end to the lower end and radially toward a central portion of the body portion, each of the plurality of ribs displaced axially from the flange portion;

wherein the second tree portion is configured to couple to the first tree portion in a plurality of discrete rotational alignments, and is configured to couple such that the second end of the first trunk portion overlaps with the first end of the second trunk portion.

2. The artificial tree of claim 1, wherein the flange portion of the coupling mechanism has an outside diameter that is larger than an outside diameter of the second end of the first trunk portion.

3. The artificial tree of claim 1, wherein the coupling mechanism comprises a plastic material.

4. The artificial tree of claim 1, wherein an axial length in a direction from the upper end to the lower end of each of the plurality of ribs of the coupling mechanism is greater than a radial height of each of the plurality of ribs.

5. The artificial tree of claim 4, wherein each of the plurality of ribs is displaced an axial distance that is greater than the radial height of each of the plurality of ribs.

6. The artificial tree of claim 5, wherein each of the plurality of ribs defines at least three outer surfaces.

7. The artificial tree of claim 6, wherein one of the at least three outer surfaces extends from the inner surface of the cylindrical inner surface of the body portion toward a central axis of the coupling mechanism at a non-acute angle.

8. The artificial tree of claim 1, wherein the plurality of discrete rotational alignments comprises six discrete rotational alignments.

9. The artificial tree of claim 1, wherein the first tree portion is configured to couple to the second tree portion such that the second tree portion must be rotated to align the plurality of ribs with portions of portions of the second tree portions, such that the portions of the second tree portion fit between the plurality of ribs.

10. The artificial tree of claim 9, wherein no more than 30 degrees of rotation is required to align the first tree portion with the second tree portion.

11. The artificial tree of claim 1, wherein the coupling mechanism includes another plurality of ribs extending in a direction from an upper portion to a lower portion, the other plurality of ribs on an outside surface of the coupling mechanism.

12. The artificial tree of claim 1, wherein the first plurality of branches are pivotally connected to the first trunk portion, such that the artificial tree is configured to collapse for storage.

13. The artificial tree of claim 1, wherein the first end of the second trunk portion defines a hexagonal shape.

14. The artificial tree of claim 1, wherein an insertable portion of the first end of the second tree portion defines a blossom shape that includes a series of concave and convex portions.

* * * * *